United States Patent [19]

Stepe

[11] 4,120,105

[45] Oct. 17, 1978

[54] BUCKET ADAPTER WITH LOAD ABSORBING MEANS

[75] Inventor: Visvaldis A. Stepe, Willow Springs, Ill.

[73] Assignee: Caterpillar Tractor Co., Peoria, Ill.

[21] Appl. No.: 824,599

[22] Filed: Aug. 15, 1977

[51] Int. Cl.[2] ..... E02F 9/28

[52] U.S. Cl. ..... 37/142 R; 37/141 T

[58] Field of Search ..... 37/141 R, 141 T, 142 R, 37/142 A; 172/681, 719, 747, 753, 762, 702; 52/758 F

[56] References Cited

U.S. PATENT DOCUMENTS

| | | | |
|---|---|---|---|
| 711,992 | 10/1902 | Mason, Jr. | 37/142 R |
| 1,772,624 | 8/1930 | Brendlin | 37/141 R |
| 3,063,176 | 11/1962 | Larson | 37/142 |
| 3,093,917 | 6/1963 | Schroeder | 37/141 T |
| 3,254,727 | 6/1966 | Helton et al. | 172/719 |
| 3,462,861 | 8/1969 | Kampert | 37/142 R |
| 3,841,007 | 10/1974 | Howarth et al. | 37/141 R |
| 3,845,578 | 11/1974 | Holmstrom | 37/141 R |
| 3,851,711 | 12/1974 | Stepe | 172/681 |
| 3,974,579 | 8/1976 | Black et al. | 37/141 T |
| 4,056,893 | 11/1977 | Willard | 37/142 R |

FOREIGN PATENT DOCUMENTS

| | | | |
|---|---|---|---|
| 2,458,361 | 12/1974 | Fed. Rep. of Germany | 37/142 R |
| 1,351,551 | 5/1974 | United Kingdom | 37/141 T |
| 1,015,876 | 1/1966 | United Kingdom | 37/141 R |

*Primary Examiner*—E. H. Eickholt

*Attorney, Agent, or Firm*—Phillips, Moore, Weissenberger, Lempio & Majestic

[57] ABSTRACT

A loader bucket having a support plate connected to the bucket base, a reversible cutting edge connected to and extending forwardly of the plate, and a tooth-adapter assembly including an adapter having a rearward portion bifurcated into upper and lower legs with a cavity therebetween to receive the support plate and cutting edge, a load-absorbing shoulder extending integrally from the upper leg into the cavity to abut a forward end of the support plate, and a tooth extending from a forward portion of the adapter.

15 Claims, 2 Drawing Figures

BUCKET ADAPTER WITH LOAD ABSORBING MEANS

BACKGROUND OF THE INVENTION

The present invention relates to earthworking equipment and, more particularly, to a tooth and adapter assembly coupled to a cutting edge of the equipment and having apparatus for absorbing a shear load applied to the tooth of the assembly.

Earthworking implements such as loader buckets usually have a support plate connected to the forward end of a bucket base, and a cutting edge bolted to the plate and extending forwardly of the plate. Tooth adapters are bolted to the support plate and extend forwardly of the cutting edge, there being earthworking teeth attached to the adapters.

In some prior loader buckets, the adapters would transmit the shear forces or loads applied to the teeth to the bolts connecting the adapters to the support plate. This would normally subject the bolts to such large strains as would cause them to shear off or the bolts to loosen in a short period of time and thereby uncouple the adapters. Consequently, adapters have been developed which fit snugly about the cutting edge whereby such shear forces are dissipated at least partially into the cutting edge. Because of this abutting relationship, the strain on the connecting bolts has been reduced whereby the likelihood of the bolts shearing has also been reduced.

Cutting edges normally have been made relatively blunt to dissipate the shear forces transmitted by abutting adapters. However, these blunt edges do not cut through the earth as efficiently as would a sharper edge. While cutting edges which are relatively sharp could be made, these would not be satisfactory for dissipating the shear forces applied to the earthworking teeth. These sharper edges simply would not be strong enough to withstand the forces and therefore would require constant repair or replacement. Moreover, the sharper edges would not dissipate as much shear load as the more blunt edges, thereby undesirably providing additional shear load on the connecting bolts and increasing the likelihood that the bolts would shear off or loosen.

SUMMARY OF THE INVENTION

The present invention is directed to overcoming one or more of the problems as set forth above.

According to the present invention, there is provided an adapter for coupling one member to another member, comprising a forward segment to receive the one member, a rearward segment bifurcated into a first upper leg and a second lower leg with a cavity therebetween to receive the other member in the cavity, and an integral load-absorbing shoulder extending from one of the legs into the cavity to abut an end of the one member.

DETAILED DESCRIPTION OF THE DRAWINGS

Figure 1:
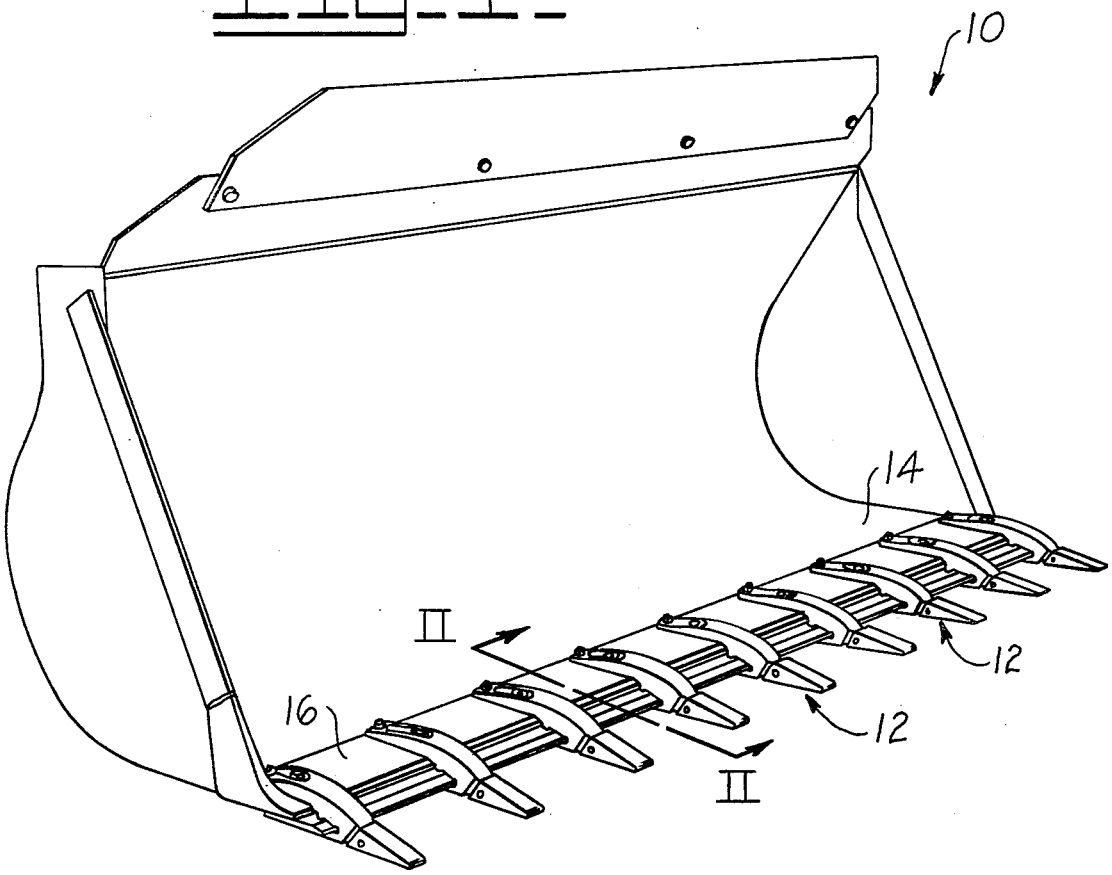
FIG. 1 illustrates an earthworking implement.
Figure 2:
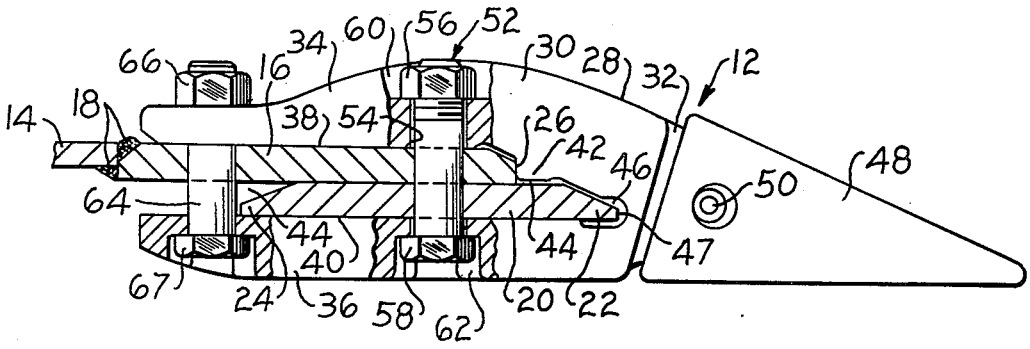
FIG. 2 is a section taken along lines II—II of FIG. 1.

With reference to FIGS. 1 and 2, there is shown an earthworking implement such as a loader bucket 10 having a plurality of tooth and adapter assemblies 12 spaced across the bucket. The implement 10 includes a bucket base 14 and a member such as a support plate 16 connected to the forward end of the base by welds 18. Another member such as a cutting edge 20 is adjacent the lower surface of the support plate 16 and extends laterally coextensively with the plate 16. The cutting edge 20 is reversible having relatively sharp front and rear ends 22 and 24, respectively, with the sharp end 22 extending forwardly of a relatively blunt forward edge 26 of the support plate 16.

The assembly 12 includes an adapter 28 having a rearward portion or segment 30 and forward portion or segment 32. The rearward segment 30 is bifurcated to provide an upper leg 34 and a lower leg 36 which straddle the two members, particularly the top surface 38 of plate 16 and the lower surface 40 of the cutting edge 20, respectively. The upper leg 34 has an integral load-absorbing shoulder 42 extending downwardly into a cavity 44 formed between the legs 34 and 36. The shoulder 42 abuts the blunt edge 26 of support plate 16, while the legs 34 and 36 are shaped to provide a clearance 46 about the forward end 22 of the cutting edge 20 and the forward end 47 of cavity 44. A member such as a tooth 48 is connected to the forward segment 32 of adapter 28 by a conventional retaining pin assembly 50.

A bolt 52 extends through an aligned bore 54 to couple together the upper leg 34, support plate 16, cutting edge 20 and lower leg 36. A nut 56 and head 58 of bolt 52 are housed within respective recesses 60 and 62 in the legs 34 and 36 to tighten the bolt 52. Another similar bolt 64 extends through the rearward portion of the leg 34, support plate 16 and leg 36 to additionally couple these elements together, with a nut 66 and head 67 being used to tighten the bolt 64.

As can be appreciated, as the teeth 48 dig into the earth, shear loads will be developed and applied to the teeth. These loads will then be transmitted through forward segment 32 to the shoulder 42 where they will then be dissipated into the support plate 16 due to the abutting relationship between blunt edge 26 and shoulder 42. Only a small amount of these shear loads will be transmitted to the bolts 52, thereby reducing the likelihood that they will shear or loosen. Moreover, due to the clearance 46, none of the shear forces will be transmitted to the relatively sharp forward end 22 so that it will not bend or break from these loads.

While the invention has been particularly shown and described with reference to a preferred embodiment thereof, it will be understood by those skilled in the art that the foregoing and other changes in form and details may be made therein without departing from the spirit and scope of the invention.

The embodiments of the invention in which an exclusive property or privilege is claimed are defined as follows:

1. An earthworking implement, comprising:

(a) a support plate having one forward end;

(b) a cutting edge extending forwardly of said one forward end of said support plate and having one forward cutting end;

(c) a tooth adapter having rearwardly extending upper and lower legs forming a cavity therebetween, said support plate and said cutting edge extending into said cavity, said adapter having an integral load-absorbing shoulder extending into said cavity and abutting said one forward end of said support plate; and (d) means for securing together said support plate, said cutting edge, and said legs.

2. An earthworking implement according to claim 1 wherein said legs and said cutting edge are shaped to provide clearance in said cavity between said legs and said one forward cutting end of said cutting edge.

3. An earthworking implement according to claim 1 wherein said one forward end of said support plate is relatively blunt and said one end of said cutting edge is relatively sharp.

4. An earthworking implement according to claim 1 wherein said shoulder extends downwardly from said upper leg.

5. An earthworking implement according to claim 1 wherein said support plate and said cutting edge are in surface contact with said cutting edge being beneath said support plate.

6. An earthworking implement according to claim 3 wherein said cutting edge is reversible having another relatively sharp cutting end.

7. An earthworking implement according to claim 1 further comprising a tooth connected to said adapter to extend forwardly therefrom.

8. An earthworking implement according to claim 1 wherein said support plate and said cutting edge extend laterally, and further comprising a plurality of tooth adapters spaced along said plate and said cutting edge.

9. An earthworking implement according to claim 1 wherein said securing means comprises a bolt.

10. An assembly for attachment to an earthworking implement having a support plate and a cutting edge connected to and extending forwardly of said plate, comprising:

(a) an adapter having a rearward portion bifurcated into a first upper leg and a second lower leg with a cavity therebetween for receiving said support plate and said cutting edge, and an integral load-absorbing shoulder extending from one of said legs into said cavity to abut on a forward end of said support plate; and (b) a tooth extending from a forward portion of said adapter.

11. An assembly according to claim 10 wherein said first leg and said second leg are shaped such that said cavity provides a clearance for a forward end of said cutting edge.

12. An assembly according to claim 11 wherein said shoulder extends downwardly from said first upper leg.

13. An adapter to couple a tooth to an earthworking implement having a support plate with a forward end and a cutting edge connected to and extending forwardly of the plate, comprising:

(a) a forward segment to receive the tooth;

(b) a rearward segment bifurcated into a first upper leg and a second lower leg with a cavity therebetween to receive the support plate and the cutting edge; and (c) an integral load-absorbing shoulder extending from one of said legs into said cavity to abut the forward end of the support plate.

14. An adapter according to claim 13 wherein said shoulder extends downwardly from said upper leg.

15. An adapter according to claim 13 wherein said shoulder is spaced from a forward end of said cavity, and said cavity is shaped by said first leg and said second leg to receive with clearance the cutting edge between said shoulder and said forward end of said cavity.

* * * * *